United States Patent [19]

Stroud

[11] 3,942,957

[45] Mar. 9, 1976

[54] PRODUCTION OF COMBUSTIBLE GASES

[75] Inventor: Henry John Francis Stroud, Solihull, England

[73] Assignee: British Gas Corporation, London, England

[22] Filed: May 7, 1974

[21] Appl. No.: 467,666

[30] Foreign Application Priority Data

May 14, 1973 United Kingdom ..... 22773/73

[52] U.S. Cl. ..... 48/196 R; 48/197 R

[51] Int. Cl.[2] ..... C10K 3/02

[58] Field of Search ..... 260/449 M, 449.6 M; 48/196 R, 197 R; 423/248

[56] References Cited

UNITED STATES PATENTS

| | | | |
|---|---|---|---|
| 2,734,809 | 2/1956 | Pettyjohn et al. | 48/197 R |
| 3,469,957 | 9/1969 | Percival et al. | 48/197 R X |
| 3,625,664 | 12/1971 | Padovani | 48/197 R |
| 3,703,052 | 11/1972 | Linden | 48/197 R X |
| 3,847,567 | 11/1974 | Kalina et al. | 48/196 R X |

FOREIGN PATENTS OR APPLICATIONS

| | | | |
|---|---|---|---|
| 820,257 | 9/1959 | United Kingdom | |
| 899,574 | 6/1962 | United Kingdom | |
| 830,960 | 3/1960 | United Kingdom | |
| 851,054 | 10/1960 | United Kingdom | 423/248 |

OTHER PUBLICATIONS

Organic Chemistry – Hendrickson et al., p. 768–771, 1970.

Cyclohexane, Cyclohexanol, and Cyclohexanone – S. A. Miller Chemical & Process Engineering, June 1969, pp. 63–72.

*Primary Examiner*—Joseph Scovronek
*Assistant Examiner*—Michael S. Marcus
*Attorney, Agent, or Firm*—Larson, Taylor and Hinds

[57] ABSTRACT

Combustible gases containing both methane and hydrogen, for example gases obtained by the non- catalytic hydrogenation of oil or coal are treated to increase their calorific value by removal of elementary hydrogen in the catalytic hydrogenation of an unsaturated compound such as benzene. The benzene is regenerated by dehydrogenation, usually catalytic dehydrogenation, and recycled for further use. The hydrogen produced on dehydrogenation may be employed for hydrodesulphurisation or as hydrogenating gas in a non- catalytic hydrogenation stage.

9 Claims, 2 Drawing Figures

PRODUCTION OF COMBUSTIBLE GASES

Figure 1:
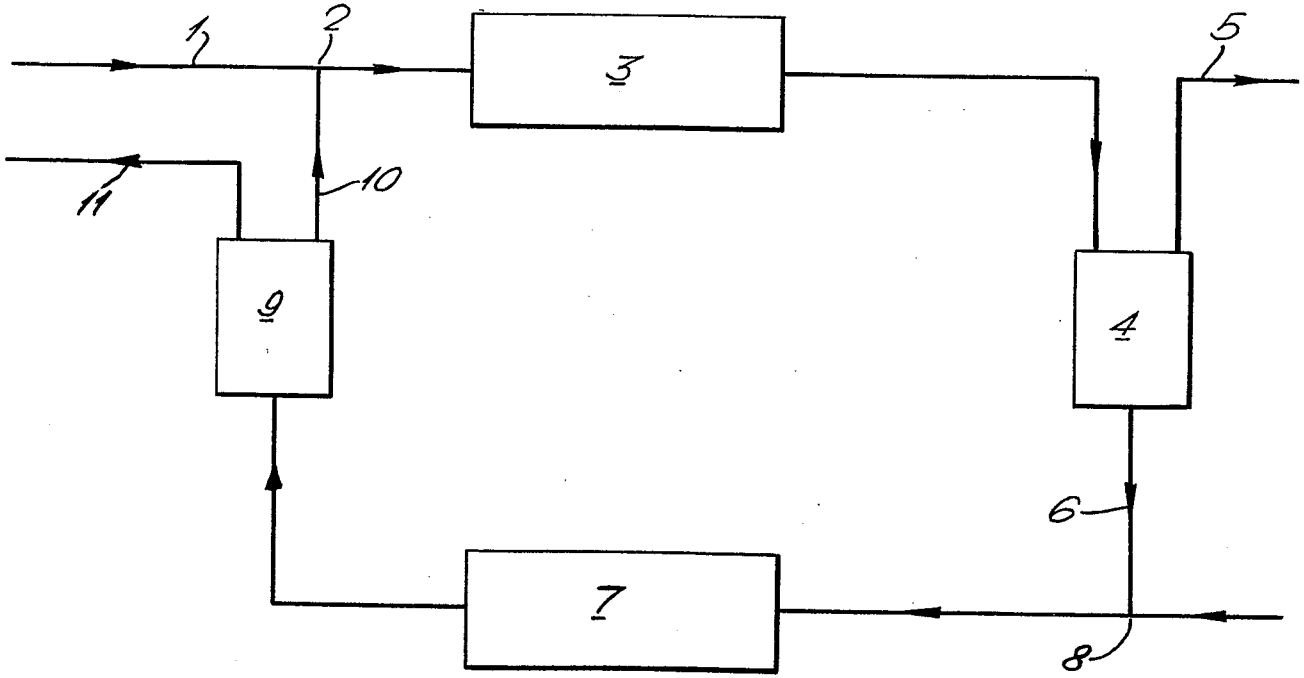

The invention relates to the production of combustible gases, and in particular to the production of substitute natural gas (SNG).

In order to broaden the range of petroleum-based feedstocks available for the production of substitute natural gas, it is desirable to be able to use hydrogenation as an alternative to catalytic steam-reforming as the primary gasification stage. Hydrogenation processes are known which are not limited to those types of distillate oils best suited to catalytic gasification, and they may even be applied to crude petroleum or a heavy cut thereof; since they are non-catalytic, the feedstock need not be purified from sulphur.

In addition processes are known for the gasification of coal. Our British Patent Specifications Nos. 830,960, 899,574, 1,031,717 and 1,154,321 describe examples of such oil gasification processes together with the appropriate plant; the latter two respectively describe what are generally known as the "Gas Recycle Hydrogenator" (GRH) and the "Fluidised-Bed Hydrogenator" (FBH).

A feature of these processes is that a stoichiometric excess of hydrogen is needed in the reactor space not only to avoid carbon deposition but to maximise the production of gaseous paraffinic hydrocarbons (which, advantageously, when it is a question of SNG production, comprise a substantial proportion of ethane) by discouraging the formation of complex mixtures of higher aromatic hydrocarbons, which are of a tarry character. Accordingly, the product gas, whether from a GRH or an FBH, will contain a substantial concentration of free hydrogen.

A typical composition of such a gas, percent by volume, is:

| $H_2$ | $CH_4$ | $C_2H_6$ | $CO_2$ | CO |
|---|---|---|---|---|
| 30 | 52 | 15 | 2 | 1. |

Carbon oxides are present in small quantities whenever, as is usual, hydrogenating gas is made by a gasification process which involves their formation. It is usual to convert carbon monoxide to carbon dioxide and to remove the dioxide, to low concentrations, by one of the well-known methods, and when it is a question of SNG production such removal is plainly essential. Since it is advantageous to maximise the partial pressure of hydrogen in the primary hydrogenator, it is preferable to conduct the carbon oxide removal operations with the object of reducing the total concentration to not more than, say 5 percent, before such gas is used as a source of hydrogen in a primary hydrogenation stage.

In the United Kingdom the calorific value of natural gas as supplied to consumers exceeds 1000 Btu/scf (60° F and 30 in. Hg. saturated); a typical value is 1017 Btu/scf. The Weaver flame speed factor is about 14. A gas of the composition given above has a calorific value of 875 Btu/scf and a Weaver flame speed factor of 24. It is principally the residual excess hydrogen that is responsible for this difference and it is therefore necessary, if a hydrogenation route is used for SNG production, to provide means for reducing the concentration of elementary hydrogen. In doing this, it is an important objective to preserve at least a major proportion, if not all, of the ethane, because of its contribution to the final calorific value.

Processes are known for conducting this operation; for instance, our British Patent Specification No. 1,171,103 describes and claims a process for solvent-extracting the gaseous hydrocarbons from the gas and recovering these. Other proposals have been made to reduce the hydrogen content of methane-containing gases. These include the catalytic hydrogenation of hydrocarbons (including aromatic hydrocarbons) and of carbon oxides to methane, and a process for catalytically reacting carbon oxides with hydrogen, with the formation of methane, in such manner as to avoid or minimise reactions between hydrogen and ethane.

Such prior proposals are not without drawbacks. When hydrogenation of, for example, oxides of carbon is effected there are problems connected with temperature control, as is required to avoid hydrogenation of the ethane to methane, and stiochiometry limits the applicability of methanation of the carbon oxides alone. For instance, quantitative methanation of carbon oxides in the gas specified hereinbefore would account for little more than one-third of the hydrogen.

According to the present invention there is provided a method of removing elemental hydrogen from a gas containing hydrogen, for example, the product gas from a hydrogenation reaction of a hydrocarbon oil or coal which method comprises adding to the gas a quantity of an unsaturated compound, catalytically reacting some of all the unsaturated compound with hydrogen to produce a hydrogenated product, separating the hydrogenated product and any remaining unsaturated compound from the remaining constituents of the gas, dehydrogenating the separated hydrogenated product to regenerate unsaturated compound, separating such unsaturated compound from the hydrogen produced in the dehydrogenation reaction, adding the resulting unsaturated compound to a further quantity of gas from which hydrogen is to be removed, and reacting some or all of the unsaturated hydrocarbon with hydrogen of the said gas.

The gas containing hydrogen, which is the feed material according to this invention, may be produced by the hydrogenation of a hydrocarbon feedstock, for example, crude petroleum or a heavy cut thereof or coal. Such a gas on leaving the hydrogenation stage may contain aromatic and other unsaturated compounds, including benzene and other monocyclic hydrocarbons as well as a substantial proportion of compounds of a polynuclear and tarry aromatic character. When operating a continuous process, it may be necessary to remove a major part of such compounds including monocyclic hydrocarbons, for example by cooling sufficiently to effect condensation of them, since they are unsuitable for use in the present process, and because it is necessary to retain full control over the quantity of unsaturated compound that is used to react with the hydrogen in the process of this invention. Such treatment of the hydrogen-containing gas may also be required should it be necessary or desirable to effect desulphurisation of the hydrogenator product gases before carrying out the method of this invention.

The reaction of unsaturated compound with hydrogen is effected catalytically to provide a more saturated compound whereafter the gas is separated from the more saturated compound and any unhydrogenated unsaturated compound preferably by cooling and condensing the latter substances. Thereafter it is necessary in the method of this invention to cause at least a part of the more saturated compound to be dehydrogenated, which will usually be a catalytic operation effected under different operating conditions from those obtaining when it was formed, so as to regenerate unsaturated compound. The regenerated unsaturated compound must be separated from liberated hydrogen, and this is preferably effected by cooling and condensation of the unsaturated compound prior to it being reused in the method, for example by being fed to the inlet of a catalytic hydrogenator so that it is used to react with a further quantity of hydrogen.

According to another embodiment, under some operating conditions it may be alternatively possible to effect dehydrogenation of the saturated compound by a non-catalytic route such as thermal decomposition, for example by returning the steam containing the more saturated compound to the primary hydrogenator where the hydrogen is available for primary hydrogenation of the feedstock and the reformed saturated compound is present in the primary hydrogenation product gas and available for reaction with hydrogen in the secondary catalytic hydrogenator.

The unsaturated compound, which may conveniently be used is admixture with the less unsaturated compound, may be introduced to a catalytic hydrogenation reactor as liquid or vapour, as determined by the need to control temperature. Adjustment of the proportion of the unsaturated compound that is converted to the more saturated compound in the hydrogenator may also be used as a means of controlling reaction conditions. Similar considerations may affect the operation of the catalytic dehydrogenator.

The unsaturated compound employed in the process of the invention should possess several requirements. Primarily, it should be capable of being readily separable from the gas stream issuing from the secondary catalytic hydrogenator. Ideally, therefore, it should have a sufficiently high boiling point to enable it to be readily condensed out, for example by cooling the whole gas stream down to about 50° C. Secondly, the unsaturated compound should preferably be more easily hydrogenated than ethane, if ethane is present in the gas undergoing treatment, having regard to the conditions obtaining in the reactor, e.g. temperature, pressure specificity of the catalyst, and concentration of unsaturated compound.

In general we have found that low molecular weight aromatic compounds, preferably containing only the elements carbon, hydrogen, and, optionally oxygen, are especially suitable for the purposes of this invention. Examples of such aromatic compounds include monocyclic aromatics such as benzene, toluene, the xylenes, phenol, and the cresols.

The proportion of unsaturated compound in the gas to be subjected to secondary hydrogenation will very depending upon the concentration of elemental hydrogen in the gas. However, the proportion of unsaturated compound may range from 20–400 lbs/1000 scf of gas, preferably 50–200 lbs/1000 scf and most preferably 75–180 lbs/1000 scf.

Preferably the unsaturated compound is benzene and the more saturated compound is cyclohexane The benzene used is conveniently a portion of that produced in the hydrogenation of the hydrocarbon feedstock, and recovered from admixture with the polynuclear tarry aromatic hydrocarbons condensed from the products of that reaction, and it may without inconvenience be used mixed with other moncyclic aromatic hydrocarbons.

The use of substituted benzenes may, under some circumstances be preferred since the electron-donating properties of the side chains exert a moderating effect on the kinetics of the hydrogenation reaction and thus the hydrogenation may be spread over a large proportion of the catalyst mass rather than concentrating the reaction at one point.

Conveniently, the hydrogenation reaction is conducted at temperatures within the range 100° to 350° C at any convenient pressure, but generally within the range 10–100 atm. Examples of suitable catalysts include nickel, or small proportions of platinum or palladium, supported on such materials as alumina, silica, carbon or magnesium silicate. The use of certain forms of Raney nickel is possible.

Catalysts compositions suitable for carrying out the hydrogenation reactions of this invention are described and claimed in our United Kingdom Patent Specification Nos. 969,637, 1150066 and 1155843. It is preferred to choose operating conditions, and a sufficiently selective catalyst, for the reactions in question to proceed while the hydrogenation of ethane is avoided or at least minimised. The hydrogenation of benzene to cyclohexane is well known per se. A modern description of such catalytic step is given by Miller, "Chemical and Process Engineering", 1969, 50 June pp. 63–72.

The catalytic decomposition of cyclohexane to benzene is similarly well known. For the purpose of this invention we prefer to operate within the range 350° C to 700° C and, advantageously, at a pressure near that of the hydrogenation stage, if the dehydrogenation stage is a catalytic one. Catalysts employed for dehydrogenation may be those conventionally employed for the reforming of hydrocarbons e.g. a precious metal in association with a support or promoter such as alumina. A typical example of such a catalyst would be a platinum-alumina composition.

The method of the invention will be described more particularly hereafter with reference to benzene and cyclohexane, but it is to be understood that the method invention includes the use of other pairs of compounds.

Figure 2:
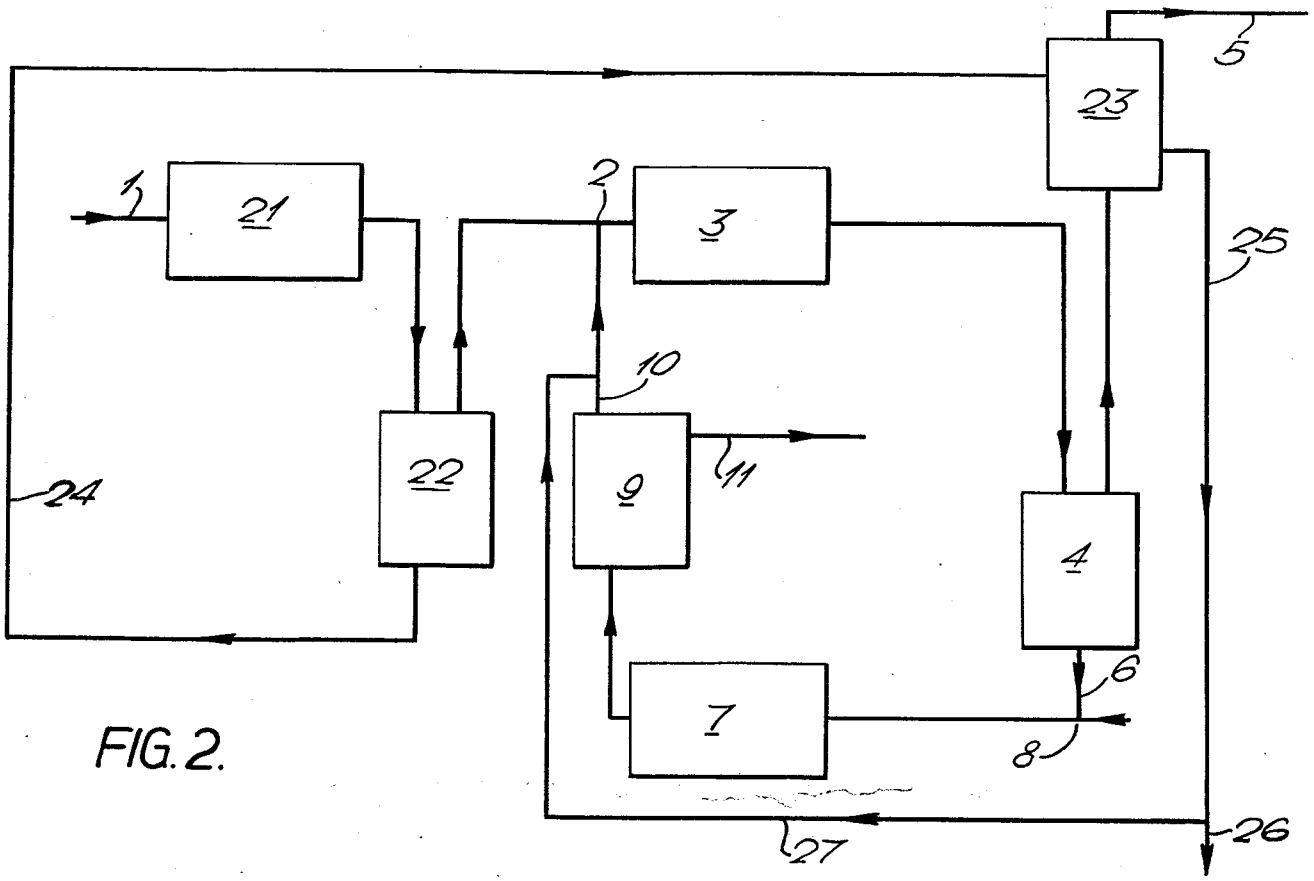

The invention in a simple form will now be more particularly described with reference to the accompanying drawings, in which both FIGS. 1 and 2 are flow diagrams illustrating the process of the invention.

Referring to FIG. 1 gas from a primary hydrogenator (not shown) that has been cooled to enable condensible materials to be removed and has been desulphurised, enters at 1 and is mixed with recycled benzene/cyclohexane mixture at 2. If desired, at least a part of this mixture may be supplied as liquid, in order that latent heat of evaporation may be used to moderate the temperature rise in reactor 3. The mixture enters the catalytic hydrogenator 3 and the products are separated at 4 into a hydrogen-impoverished gas stream 5 and a cyclohexane-enriched liquid mixture 6. The latter is evaporated and passed into the dehydrogenator 7. It may be advantageous, for the sake of the preservation of the life of the catalyst and the avoidance of carbon deposition, to mix hydrogen at 8 with the input to 7; some hydrogen will already be present, dissolved in the liquid. The product is separated at 9 into a liquid benzene-enriched mixture which flows via 10 to meet fresh primary product gas at 2, and a stream of hydrogen 11 which may conveniently be returned to the input of the primary hydrogenator.

The quantities of benzene used are generally not such as to provide for quantitative conversion to cyclohexane, even insofar as this would be permitted by thermodynamics. Subject to the attainment of satisfactory thermal efficiency, the important consideration is that the hydrogen should be removed at as low a temperature as possible, to minimise ethane hydrogenation if ethane is present and the circulation of unreacted benzene may be advantageous as a means of ensuring temperature control.

It will be understood that fresh benzene can be supplied through a pipe (not shown) to make good any losses such as must arise, for instance, by the necessary presence of benzene vapour in the outlet gas at 5.

A further aspect of the invention arises from the consideration that it may be necessary to remove the benzene vapour that remains in the effluent gas after cooling and condensation of the benzene-cyclohexane mixture before, for example, the gas can be admitted to a distribution system. It is known that a convenient means of effecting this is to scrub the gas, preferably at near ambient temperature and at elevated pressure, with cyclohexane. The further aspect of the invention therefore provides, in addition means for furnishing a supply of cyclohexane comprising a catalytic reaction stage through which the primary hydrogenator product gas, if necessary with the addition of benzene over and above that which it already contains as vapour, is caused to pass before it reaches the outside catalytic hydrogenation reactor hereinbefore described, hereinafter termed the principal catalytic hydrogenator, in which the benzene is substantially quantitatively converted to cyclohexane, means for separating the cyclohexane from the thus-treated gas, a scrubber or packed tower in which the hydrogen-impoverished gas is scrubbed with the cyclohexane which is delivered to it. The mixture of benzene and cyclohexane leaving the scrubber may be used in any suitable way, but means may be provided for adding any convenient proportion of it to the mixture of benzene and cyclohexane being supplied to the principal catalytic hydrogenator hereinbefore described.

These further aspects of the invention will now be described more particularly with reference to FIG. 2 of the accompanying drawings. Reference numbers in FIG. 2 that have already been used in FIG. 1 denote the same items in both Figures.

The primary hydrogenator product gas, which already contains some benzene vapour, although the bulk of the benzene has been removed, enters at 1, if necessary after the addition of more benzene and passes through the preliminary hydrogenation reactor 21 wherein the benzene is substantially quantitatively converted to cyclohexane, and thence to a separator 22 wherein the cyclohexane is removed from the partially hydrogen-impoverished gas before the latter enters the principal catalytic hydrogenator 3, after the admixture of the circulating benzene-cyclohexane mixture at 2. The gas, after leaving the separator 4, passes to the scrubber or packed tower 23, where it is contacted with cyclohexane produced in 21, isolated in 22, and delivered to the scrubber via pipe 24. The final debenzolised and hydrogen-impoverished gas leaves via 5.

As with the simplier form of the invention, but more conveniently when there has been thorough benzene removal, the gas may if desired be subjected to further enrichment processes, such as methanation of the carbon oxides, with or without hydrogenation of the ethane, before it is admitted to the distribution system. It is an advantage of the present invention that it provides such a degree of enrichment of the final gas that in such a final stage of treatment some hydrogenation of the ethane to methane can be tolerated.

The effluent from the scrubber leaves via pipe 25 and may leave the system along pipe 26, or it may pass along pipe 27 to supplement the mixture flowing along pipe 10 to be used for the treatment of the primary hydrogenator gas. A portion of the flow along pipe 27 may if desired be led by a pipe, (not shown) to the inlet of 21 to provide, in virtue of its benzene content, for the supply of the additional benzene to this preliminary catalytic hydrogenator. It will be appreciated that the flow along 25 can be divided in any convenient proportion between 26 and 27.

Both forms of the invention have been specifically described in terms of the single-stage hydrogenation and dehydrogenation in reactors. It is to be understood that if desired either reaction can be carried out in a plurality of stages in series, with inter-stage temperature adjustment.

Certain benzene hydrogenation catalysts, especially at the lowest operating temperatures, may be adversely affected by the presence of carbon monoxide. Where it is nevertheless desired to use such catalysts and operating conditions, it may be desirable to pretreat the hydrogenating gas for the more thorough reduction of the carbon monixde concentration than is implied by the example of a primary hydrogenator exit gas composition stated hereinbefore. Means, such as low-temperature methanation after carbon dioxide removal are available for this purpose.

In the examples which follow the treatment of gases containing no carbon monoxide, as well as of gas containing a small proportion thereof, is illustrated. The catalysts employed for the hydrogenation stage was co-precipitated nickel-aluminium catalysts and the catalyst employed for the dehydrogenation stage was a conventional hydrocarbon reforming catalyst.

Following is a description by way of example only of methods of performing the invention:

EXAMPLE I

This example illustrates the invention in its simple form as described above with reference to FIG. 1 of the drawings. There is no final benzene scrubber and no preliminary cyclohexane-producing reactor, and the hydrogen-absorbing material is fully vaporised before it is mixed with the primary hydrogenator product gas. This gas contains no carbon oxides, hydrogenating gas for the primary hydrogenator having been prepared by a dehydrogenation process which produces a gas free from carbon oxides.

| | |
|---|---|
| Volume of substantially debenzolised, desulphurized primary hydrogenator product gas, benzole-free basis. | 1000 scf |
| Benzene content | 2 lb |
| Composition, per cent by volume, benzene-free basis: | |

| $H_2$ | $CH_4$ | $C_2H_6$ |
|---|---|---|
| 30 | 55 | 15 |

| | |
|---|---|
| Pressure of operation | 420 psig |

-continued

| | |
|---|---|
| Quantity of benzne-cyclohexane mixture added in vapour form at inlet catalytic hydrogenator | 150 lb |
| Benzene content of this mixture, per cent by wt. | 80 |
| Temperatures of the catalytic hydrogenator gas and vapour streams: | |
| Inlet | 200°C |
| Outlet | 317°C |
| Quantity of Benzene-cyclohexane mixture leaving the separator at outlet catalytic hydrogenator | 153 lb |
| Benzene content of this mixture, per cent by wt. | 69.3 |
| Volume of hydrogen-improverished gas leaving the system, benzene-free basis. | 778 s.c.f. |
| Composition, per cent by volume, benzene-free basis: | |

| $H_2$ | $CH_4$ | $C_2H_6$ |
|---|---|---|
| 10.0 | 70.7 | 19.3 |

Volume of hydrogen added to the vapour of the cyclohexane-enriched mixture before entry to the catalytic dehydrogenator.

| | |
|---|---|
| | 72 s.c.f. |
| Temperatures of the catalytic dehydrogenator gas and vapour streams: | |
| Inlet | 540°C |
| Outlet | 420°C |
| Volume of hydrogen separated from the mixture leaving the catalytic dehydrogenator. | 294 s.c.f. |

EXAMPLE II

This example illustrates of simple form of the invention in which there is no final benzene scrubber. The pressure, and the catalytic hydrogenator operation temperatures are such that liquid is present both at the inlet and the outlet. The gas being treated contains small concentrations of carbon oxides.

| | |
|---|---|
| Volume of substantially debenzolized, desulphurised primary hydrogenator product gas benzene-free basis. | 1000 s.c.f. |
| Benzene content. | 2 lb. |
| Composition, per cent by volume, benezene-free basis: | |

| $CO_2$ | CO | $H_2$ | $CH_4$ | $C_2H_6$ |
|---|---|---|---|---|
| 2 | 1 | 30 | 52 | 15 |

| | |
|---|---|
| Pressure of operation. | 1000 p.s.i.g. |
| Quantity of benzene-cyclohexane mixture added an inlet catalytic hydrogenator. | 208 lb. |
| Benzene content of this mixture, per cent by wt. | 75 |
| Temperatures of the catalytic hydrogenator material streams: | |
| Inlet | 142°C |
| Outlet | 200°C |
| Quantity of benzene-cyclohexane mixture leaving the separator at outlet catalytic hydrogenator. | 211 lb. |

-continued

| | |
|---|---|
| Benzene content of this mixture, per cent by wt. | 67.3 |
| Volume of hydrogen-improverished gas leaving the system, benzene-free basis. | 778 s.c.f. |
| Composition, per cent by volume, benezene-free basis: | |

| $CO_2$ | CO | $H_2$ | $CH_4$ | $C_2H_6$ |
|---|---|---|---|---|
| 2.6 | 1.3 | 10.0 | 66.9 | 19.3 |

| | |
|---|---|
| Volume of hydrogen added to the cyclohexane-enriched mixture before entry to the catalytic dehydrogenator. | 105 s.c.f. |
| Temperatures of the catalytic dehydrogenator material streams: | |
| Inlet | 520°C |
| Outlet | 449°C |
| Volume of hydrogen separated from the mixture leaving the catalytic dehydrogenator. | 327 s.c.f. |

EXAMPLE III

This example illustrates the form of the invention in which there is no final benzene scrubber, with operation at a lower pressure than in Example II so that in the catalytic hydrogenator a greater proportion of the reaction heat can be absorbed by vaporisation. Accordingly a smaller quantity of hydrogen-absorbing material is used and a choice is presented between using a single catalytic dehydrogenator operating at a comparatively high inlet temperature, or two such reactors in series with intermediate reheating:

| | |
|---|---|
| Volume of substantially debenzolized, desulphurised primary hydrogenator product gas, benzene-free basis. | 1000 s.c.f. |
| Benzene content | 2 lb. |
| Composition, per cent by volume, benzene-free basis: | |

| $CO_2$ | CO | $H_2$ | $CH_4$ | $C_2H_6$ |
|---|---|---|---|---|
| 2 | 1 | 30 | 52 | 15 |

| | |
|---|---|
| Pressure of operation. | 420 p.s.i.g. |
| Quantity of benzene-cyclohexane mixture added at inlet catalytic hydrogenator | 120 lb. |
| Benzene content of this mixture, per cent by wt. | 75 |
| Temperatures of the catalytic hydrogenator material streams: | |
| Inlet | 150°C |
| Outlet | 223°C |
| Quantity of benzene-cyclohexane mixture leaving the separator at outlet catalytic hydrogenator. | 123 lb. |
| Benzene content of this mixture, per cent by weight. | 61.8 |
| Volume of hydrogen-impoverished gas leaving the system, benzene-free basis. | 778 s.c.f. |
| Composition, per cent by volume, benzene-free basis: | |

| $CO_2$ | CO | $H_2$ | $CH_4$ | $C_2H_6$ |
|---|---|---|---|---|
| 2.6 | 1.3 | 10.0 | 66.9 | 19.3 |

| | |
|---|---|
| Volume of hydrogen added to the cyclohexane-enriched mixture before entry to the catalytic dehydrogenator | 62 s.c.f. |
| Temperatures of the catalytic dehydrogenator material streams (a) when a single reactor is used: | |
| Inlet | 553°C |
| Outlet | 410° C |

(b) when two reactors are used in series with inter-stage reheating:

| | Stage 1 | Stage 2. |
|---|---|---|
| Inlet | 481°C | 482°C |
| Outlet | 410°C | 410°C |

| | |
|---|---|
| Volume of hydrogen separated from the mixture leaving the catalytic dehydrogenator. | 284 s.c.f. |

EXAMPLE IV

This example illustrates the more complex form of the invention, in which the hydrogen-impoverished gas is scrubbed with cyclohexane for removal of benzene vapour before it is admitted to the transmission system, the cyclohexane being produced in a preliminary catalytic hydrogenator. The feed to the preliminary hydrogenator is a portion of the benzene scrubber effluent liquid.

| | |
|---|---|
| Volume of substantially debenzolized, desulphurised primary hydrogenator product gas, benzene-free basis. | 1000 s.c.f. |
| Composition, per cent by volume, benzene-free basis: | |
| $CO_2$ CO $H_2$ $CH_4$ $C_2H_6$ | |
| 2 1 30 52 15 | |
| Pressure of operation. | 420 p.s.i.g. |
| Quantities of benzene and cyclohexane present in gas at entry to preliminary (cyclohexane-producing) reactor: | |
| Benzene: 2.3 lb. in gas and 0.7 ob. in scrubber effluent liquid supplied total | 3.0 lb. |
| Cyclohexane in scrubber effluent liquid supplied | 1.0 lb. |
| Temperatures of the preliminary catalytic hydrogenator material streams: | |
| Inlet | 200°C |
| Outlet | 268°C |
| Quantity of liquid separated at outlet preliminary catalytic hydrogenator for supply to final benzene scrubber | 2.3 lb. |
| Cyclohexane content of this liquid, per cent by wt. | 99.1 |
| Volume of gas passing to the principal catalytic hydrogenator, benzene-free basis. | 959 s.c.f. |
| Composition of this gas, per cent by volume: | |
| $CO_2$ CO $H_2$ $CH_4$ $C_2H_6$ | |
| 2.1 1.1 27.0 54.2 15.6 | |
| Quantity of benzene-cyclohexane mixture added at inlet principal catalytic hydrogenator. | 120 lb. |
| Benzene content of this mixture, per cent by wt. | 75 |
| Temperature of the principal catalytic hydrogenator material streams: | |
| Inlet | 200°C |
| Outlet | 310°C |
| Quantity of benzene and cyclohexane entering the final benzene scrubber: | |
| Benzene | 1.25 lb. |
| Cyclohexane | 0.75 lb. |
| Volume of hydrogen-impoverished debenzolized gas leaving the system. | 778 s.c.f. |

-continued

| | |
|---|---|
| Composition of this gas, per cent by volume: | |
| $CO_2$ CO $H_2$ $CH_4$ $C_2H_6$ | |
| 2.6 1.3 10.0 66.9 19.3 | |
| Quantity of liquid leaving benzene removal scrubber. | 2.8 lb. |
| Composition of liquid leaving benzene removal scrubber, per cent by wt: | |
| Benzene | 40 |
| Cyclohexane | 60 |
| Quantity of benzene-cyclohexane mixture leaving the separator at outlet principal catalytic hydrogenator. | 120.9 lb. |
| Benzene content of this mixture, per cent by wt. | 62.6 lb. |
| Volume of hydrogen added to the cyclohexane-enriched mixture before entry to the catalytic dehydrogenator. | 60 s.c.f. |
| Temperatures of the catalytic dehydrogenator material streams, using two reactors in series with inter-stage reheating: | |
| Stage 1 Stage 2. | |
| Inlet 526°C 527°C | |
| Outlet 450°C 450°C | |
| Volume of hydrogen separated from the mixture leaving the catalytic hydrogenator | 282 s.c.f. |

A comment that should follow the last Example is that the use of cyclohexane as a scrubbing liquid for benzene removal involves the presence of some cyclohexane vapour in the gas leaving the system. This is not disadvantageous since the presence of cyclohexane vapour will present no problems either in any subsequent catalytic enrichment stage, or in the transmission and distribution system, or in eventual combustion.

EXAMPLE V

This example illustrates an alternative to the simple form of the invention in which the hydrogen component of the treated gas is further reduced by partial hydrogenation of ethane, hydrogenation of ethylene, methanation and the water gas shift reaction. The reactions occur simultaneously with benzene hydrogenation in the catalytic hydrogenator. The gas being treated therefore contains some carbon oxides and ethylene. The catalytic hydrogenator is operated so that a proportion of the reaction heat can be absorbed by vaporisation of the liquid benzene-cyclohexane component.

| | |
|---|---|
| Volume of substantially debenzolised, desulphurised primary hydrogenator product gas, benzene-free basis | 1000 s.c.f. |
| Benzene content | 2 lb. |
| Composition, % volume benzene-free basis: | |
| $CO_2$ CO $H_2$ $CH_4$ $C_2H_4$ $C_2H_6$ | |
| 1.0 1.0 30.3 44.6 0.4 22.7 | |
| Pressure of operation | (500 psig) |
| Quantity of benzene-cyclohexane mixture added at inlet catalytic hydrogenator | 156 lb. |
| Benzene content of this mixture % wt. | 79.2 |
| Temperatures of the catalytic hydrogenator material streams: | |
| Inlet | 180°C |
| Outlet | 307°C |
| Quantity of benzene-cyclohexane mixture leaving the separator at outlet catalytic hydrogenator | 159 lb. |
| Benzene content of this mixture, % wt. | 68.6 |
| Volume of hydrogen-improverished gas leaving the system, benzene-free basis. | 744 s.c.f. |
| Composition % volume benzene-free basis | |
| $CO_2$ CO $H_2$ $CH_4$ $C_2H_4$ $C_2H_6$ | |
| 0.9 0 0.5 70.5 0 28.1 | |
| Volume of hydrogen added to the cyclohexane enriched mixture before entry to the catalytic dehydrogenator | 82 s.c.f. |
| Temperatures of the catalytic dehydrogenator material streams: | |
| Inlet | 500°C |
| Outlet | 393°C |
| Pressure of operation | (478 psig) |
| Volume of hydrogen separated from the mixture leaving | |

-continued

| | |
|---|---|
| the catalytic dehydrogenator. | 300 s.c.f. |

EXAMPLE VI

This example illustrates the simple form of the invention. The gas being treated contains a small proportion of carbon oxides but no ethane. Methanation and water gas shift reactions occur simultaneously with benzene hydrogenation in the catalytic hydrogenator. The pressure, and the catalytic hydrogenator operation temperatures are such that liquid is present only at the inlet.

| | | | | |
|---|---|---|---|---|
| Volume of substantially debenzolised, desulphurized primary hydrogenator product gas, benzene-free basis. | | | | 1000 s.c.f. |
| Benzene content | | | | 2 lb. |
| Composition % volume benzene-free basis: | | | | |
| $CO_2$ | CO | $H_2$ | $CH_4$ | |
| 0.2 | 0.5 | 49.9 | 49.4 | |
| Pressure of operation | | | | (500 p.s.i.g.) |
| Quantity of benzene-cyclohexane mixture added at let catalytic hydrogenator. | | | | 158 lb. |
| Benzene content of this mixture % wt | | | | 60.6 |
| Temperatures of the catalytic hydrogenator material streams: | | | | |
| | Inlet | | | 180°C |
| | Outlet | | | 315°C |
| Quantity of benzene-cyclohexane mixture leaving the separator at outlet catalytic hydrogenator. | | | | 161.5 lb. |
| Benzene content of this mixture % wt. | | | | 48.5 |
| Volume of hydrogen-impoverished gas leaving the system, benzene-free basis | | | | 715 s.c.f. |
| Composition, % volume benzene-free basis | | | | |
| $CO_2$ | CO | $H_2$ | $CH_4$ | |
| 0 | 0 | 29.1 | 70.9 | |
| Volume of hydrogen added to the cyclohexane-enriched mixture before entry to the catalytic dehydrogenator | | | | 82 s.c.f. |
| Temperatures of catalytic dehydrogenator material streams: | | | | |
| | Inlet | | | 500°C |
| | Outlet | | | 382°C |
| Pressure of operation | | | | 578 p.s.i.g. |
| Volume of hydrogen separated from the mixture leaving the catalytic hydrogenator. | | | | 341 s.c.f. |

The invention is not limited by the examples set forth above; for example the method of this invention may be carried out using internally-cooled (non adiabatic) catalytic hydrogenators. The upgrading of the primary hydrogenator gas by the employment of this invention is clearly illustrated by the physical data presented in the following table for the fuel gases produced:

| Example No. | 1 | 2 | 3 | 4 | 5 | 6 |
|---|---|---|---|---|---|---|
| Primary Hydrogenator Outlet | | | | | | |
| CV (Btu/scf) | 902 | 875 | 875 | 875 | 943 | 650 |
| Wobbe No. | 1300 | 1231 | 1231 | 1231 | 1292 | 1157 |
| WFSF* | 24 | 24 | 24 | 24 | 24 | 35 |
| Secondary Hydrogenator Outlet | | | | | | |
| CV (btu/scf) | 1068 | 1042 | 1042 | 1042 | 1189 | 796 |
| Wobbe No. | 1381 | 1309 | 1309 | 1309 | 1425 | 1239 |
| WFSF* | 18 | 17 | 17 | 17 | 15 | 24 |

*WFSF - Weaver Flame Speed Factor.

By employment of the invention described and illustrated above various proporations of hydrogen can be removed from hydrogen containing gases, and residual concentrations below 5 percent may be achieved.

In addition to the advantages obtained by the practice of this invention in the upgrading of fuel gas and the use of regenerative materials for obtaining the advantages, the hydrogen produced on dehydrogenation may be recycled back to the upstream portions of the gas making plant as source of both heat and feedstock (i.e. hydrogenating gas) and/or as pretreatment reagent. Thus for example the hydrogen and its heat content may be employed for use in the primary hydrogenator, for use in catalytic hydrogasification in associated gas making plants employed for the gasification of lighter feedstocks, or as a hydrogenating gas in the hydrodesulphurisation of feedstocks undergoing catalysed reactions. The heat recovered and put back into the plant may make the thermally efficincy of the whole gas making plant in excess of 80.0%.

I claim:

1. In a process for the production of combustible gases containing both hydrogen and methane, said combustible gases being formed by the non-catalytic hydrogenation of oil or coal, the improvement comprising i. subjecting said gas in admixture with an aromatic compound selected from the group consisting of benzene, toluene, xylene, phenol and cresol to a secondary hydrogenation reaction in the presence of a hydrogenation catalyst and wherein:

a. the ratio of aromatic compound to gas ranges from 20 to 400 lbs/1000 scf, and b. the hydrogenation is effected at a temperature of 100–350° C and at a pressure of 10 to 100 atmospheres, to effect hydrogenation of said aromatic compound to a saturated compound, ii. thereafter separating said saturated compound and any unreacted aromatic compound from said gas by cooling said gas to effect condensation of said saturated and aromatic compounds, iii. dehydrogenating said separated saturated compound by contacting said saturated compound with a hydrocarbon reforming catalyst at a temperature of 350° to 700° C and at substantially the same pressure as that employed for secondary hydrogenation reaction to effect dehydrogenation of said saturated compound to hydrogen and said aromatic compound, iv. adding said regenerated aromatic compound to a further quantity of gas and catalytically reacting said aromatic compound with hydrogen present in said gas and v. adding hydrogen produced in step (iii) to the reactor in which the non-catalytic hydrogenation of said oil or coal is taking place, whereby the calorific value of said gas is increased by removal of hydrogen from said gas.

2. A method of removing elemental hydrogen from a methane containing gas also containing hydrogen, which method comprises adding to the gas a quantity of a monocyclic aromatic compound, reacting some or all of said monocyclic aromatic compound with hydrogen in the presence of a hydrogenation catalyst to produce a hydrogenated product, separating the hydrogenated product and any remaining monocyclic aromatic compound from the remaining constituents of the gas, dehydrogenating the separated hydrogenated product to regenerate monocyclic aromatic compound, adding the resulting monocyclic aromatic compound to a further quantity of gas from which hydrogen is to be removed, and reacting some or all of the monocyclic aromatic compound with hydrogen of the said gas.

3. A method as claimed in claim 2 in which the compound is benzene, toluene, phenol, a xylene, or a cresol.

4. A method according to claim 2 wherein said hydrogenation reaction is carried out at a temperature of 100° to 350° C and at a pressure of from 10 to 100 atmospheres.

5. A method according to claim 2 wherein said hydrogenation catalyst is a co-precipitated nickel-alumina catalyst.

6. A method according to claim 2 wherein said dehydrogenation is a catalytic dehydrogenation reaction.

7. A method as claimed in claim 6 wherein a hydrocarbon reforming catalyst is employed as a dehydrogenation catalyst.

8. A method as claimed in claim 6 wherein said dehydrogenation is carried out at a temperature of 350° C to 700° C.

9. A method as claimed in claim 8 wherein said dehydrogenation is carried out at substantially the same pressure as the hydrogenation reaction.

* * * * *